US007858890B2

(12) United States Patent
Huang et al.

(10) Patent No.: US 7,858,890 B2
(45) Date of Patent: Dec. 28, 2010

(54) WATERPROOF ROTARY SWITCH

(75) Inventors: Chen-Hong Huang, Taoyuan (TW); Chia-Yi Cheng, Taoyuan (TW); Chia-Wei Lin, Taoyuan (TW)

(73) Assignee: SOLTEAM Electronics Co. Ltd., Taoyuan (TW)

( * ) Notice: Subject to any disclaimer, the term of this patent is extended or adjusted under 35 U.S.C. 154(b) by 191 days.

(21) Appl. No.: 12/010,510

(22) Filed: Jan. 25, 2008

(65) Prior Publication Data

US 2009/0277761 A1 Nov. 12, 2009

(30) Foreign Application Priority Data

Nov. 27, 2007 (CN) ..... 2007 2 0306999 U

(51) Int. Cl.
*H01H 19/06* (2006.01)

(52) U.S. Cl. ..... 200/302.3; 200/302.1; 200/61.86; 200/569; 200/336

(58) Field of Classification Search ..... 200/11 R–11 K, 200/564–569, 572, 302.1–302.3, 336, 303, 200/307, 61.86, 329–331, 6 T–6 C; 341/35; 345/184

See application file for complete search history.

(56) References Cited

U.S. PATENT DOCUMENTS 3,629,535 A * 12/1971 Walters et al. ..... 200/302.3
4,255,626 A * 3/1981 Watts et al. ..... 200/6 A
4,861,949 A * 8/1989 Bortolloni et al. ..... 200/5 R
4,937,407 A * 6/1990 Osika ..... 200/302.3
5,506,378 A * 4/1996 Goldenberg ..... 200/345
5,650,601 A * 7/1997 Krueger et al. ..... 200/61.86
6,096,987 A * 8/2000 Krueger et al. ..... 200/61.86
6,664,901 B1 * 12/2003 Yamada et al. ..... 341/22
6,720,512 B1 * 4/2004 Rothbauer et al. ..... 200/330
7,148,440 B2 * 12/2006 Gjerde ..... 200/569
7,310,084 B2 * 12/2007 Shitanaka et al. ..... 345/156
7,358,453 B2 * 4/2008 Tsunoda ..... 200/339
2001/0020576 A1 * 9/2001 Campana et al. ..... 200/336

* cited by examiner

*Primary Examiner*—Michael A Friedhofer
(74) *Attorney, Agent, or Firm*—Roger H. Chu

(57) ABSTRACT

A waterproof rotary switch includes a holder base that has hooks extending from the periphery, a switching component set that is mounted on the holder base and has a fixed metal terminal with a fixed contact, a movable metal terminal with a movable contact, and two conductors respectively connected to the fixed metal terminal and the movable metal terminal, an actuator that is mounted in the holder base and has an actuating portion rotatable with the actuator to move the movable contact of the movable metal terminal into contact the fixed contact of the fixed metal terminal to close the circuit or away from the fixed contact of the fixed metal terminal to open the circuit, and a top cover that covers the holder base to hold the switching component set and the actuator on the holder base and has a plurality of hook holes that receive the hooks of the holder base respectively and a plurality of wire slots for the passing of the conductors and a top wall sloping downwardly outwards to the periphery of the top cover for guiding water away quickly.

16 Claims, 8 Drawing Sheets

4
43
44
41
42
42
311
33
31
32
3
342
34
341
23
2
23
21
25
211
24
221
53
222
25
5
532
22
531
55
24
51
53
23
55
532
55
531
2
55
52
54
23
541
21
55
541
54
24
222
25
221
112
211
1
111
12
22
24
14
25
11
111
112
13
111
14
14
141
111

WATERPROOF ROTARY SWITCH

BACKGROUND OF THE INVENTION

1. Field of the Invention

The present invention relates a rotary switch and more particularly to a waterproof rotary switch that lowers the change of entering of water into the inside of the switch, assuring safety.

2. Description of the Related Art

A switch is a requisite device for controlling the supply of power supply. By means of a power switch, the user can cut off power supply when the power supply is not necessary, preventing a disaster. A power supply control switch can be a normal-close switch that is constantly kept in a close-circuit position and can be operated to switch off the power supply when the power supply is not necessary. Alternatively, a power supply control switch can be a normal-open switch that is constantly kept in an open-circuit status and can be operated to switch on the power supply when the power supply is required. Therefore, regular electric devices are commonly equipped with a power switch for power on/off control. Basically, a power switch obtains power supply by means of electrically connecting two electrodes to close the power circuit. When the two electrodes are disconnected, the power circuit is off.

In addition to accurate conduction and disconduction, safety is an important factor must be taken into account during the use of a power switch. For example, a power switch must prevent electric leakage and eliminate conduction error. For use in certain particular places, such as powder dust floating or high humidity working environment, a power switch must provide a dustproof or waterproof function to prevent short-circuit or rust that may shorten the service life of the switch.

U.S. Pat. No. 7,148,440 B2 discloses a switch structure, entitled "Stackable switch assembly", which includes a base switch housing having a first switch disposed therein, and including base switch housing surface structure; at least one intermediate switch housing having an other switch disposed therein, the intermediate switch housing including intermediate switch housing surface structure that confronts and cooperates with the base switch housing surface structure to directly attach and mechanically engage the intermediate switch housing to the base switch housing; a cover including cover surface structure for selective positioning in confrontation against, attachment to and engagement with the base switch housing surface structure and the intermediate switch housing surface structure; and an actuator disposed within the base switch housing and the intermediate switch housing for operating the first switch and the other switch.

The stackable switch assembly of U.S. Pat. No. 7,148,440 B2 is used in a gas control valve. When rotating the rotary knob of the gas control valve, the actuator is rotated to squeeze an ignition device (piezoelectric device), causing conduction between the ignition device and the components of one switch of the stackable switch assembly to form a loop and to ignite the gas burner. At the same time, the loop formed of the other switch turns on an indicator light, indicating the burning status of the gas burner. This stackable switch assembly overcomes the inconvenience of a single-loop switch design.

According to the aforesaid stackable switch assembly, the top and bottom sides of the intermediate switch housing are respectively abutted against the cover and the base switch housing. Because the stackable switch assembly is used in a gas burner, for example, a gas range, the boiled fluid of the cooking food may overflow and drop to the inside of the gas control valve and the internal components of the switches of the stackable switch assembly when the user uses the gas range to cook food, or water may leak into the inside of the gas control valve and the internal components of the switches of the stackable switch assembly when the user is cleaning the gas range with water. When a fluid or water enters the switches of the stackable switch assembly, the internal components of the switches of the stackable switch assembly will be wetted, causing a short circuit to turn on the indicator light erroneously as the actuator is not operated.

Therefore, it is desirable to provide a waterproof switch that eliminates the aforesaid problem.

SUMMARY OF THE INVENTION

The present invention has been accomplished under the circumstances in view. It is the main object of the present invention to provide a waterproof rotary switch, which uses a specially designed top cover to cover a holder base, or a holder base and an intermediate switching housing, and a stepped actuator for switching control with at least one drain hole for carrying penetrated water out of the rotary switch, minimizing the possibility of leakage of water into the inside of the rotary switch, and preventing a short circuit or oxidization of the internal component parts and prolonging the service life of the rotary switch.

According to one embodiment of the present invention, the waterproof rotary switch comprises a holder base, the holder base comprising a plurality of hooks extending from at least two opposite peripheral sides thereof; a switching component set mounted on the holder base, the switching component set comprising a fixed metal terminal, a movable metal terminal, and two conductors respectively connected to the fixed metal terminal and the movable metal terminal, the fixed metal terminal having a contact, the movable metal terminal having a contact movable relative to the contact of the fixed metal terminal and adapted for contacting the contact of the fixed metal terminal; an actuator mounted in the holder base, the actuator having an actuating portion rotatable with the actuator to move the contact of the movable metal terminal between a first position where the contact of the movable metal terminal contacts the contact of the fixed metal terminal and a second position where the contact of the movable metal terminal is disconnected from the contact of the fixed metal terminal; and a top cover covering the holder base to hold the switching component set and the actuator on the holder base, the top cover comprising a plurality of hook holes that receive the hooks of the holder base respectively, a plurality of wire slots for the passing of the conductors, and a top wall sloping downwardly outwards to the periphery of the top cover.

According to another embodiment of the present invention, the waterproof rotary switch comprises a holder base, the holder base comprising a plurality of hooks extending from at least two opposite peripheral sides thereof; an intermediate switch housing mounted on the holder base, the intermediate switch housing comprising a partition wall disposed on a middle part thereof and dividing the intermediate switch housing into an upper part and a lower part, a center axle hole cut through the center of the intermediate partition wall, two locating structures respectively disposed at top and bottom sides of the partition wall, and a plurality of mounting wings respectively attached to the hooks of the holder base; two switching component sets respectively mounted in the locating structures of the intermediate housing at two opposite sides of the partition wall, the switching component sets each comprising a fixed metal terminal, a movable metal terminal, and two conductors respectively connected to the fixed metal terminal and the movable metal terminal, the fixed metal terminal having a contact, the movable metal terminal having a contact movable relative to the contact of the fixed metal terminal and adapted for contacting the contact of the fixed metal terminal; an actuator mounted in the holder base and inserted through the center axle hole of the partition wall, the actuator having an actuating portion rotatable with the actuator to move the contacts of the movable metal terminals of the two switching component sets between a first position where the contacts of the movable metal terminals of the two switching component sets respectively contact the contacts of the fixed metal terminals of the two switching component sets and a second position where the contacts of the movable metal terminals of the switching component sets are respectively disconnected from the contacts of the fixed metal terminals of the switching component sets; and a top cover covering the intermediate housing and the holder base to hold the intermediate housing and the switching component sets and the actuator on the holder base, the top cover comprising a plurality of hook holes that receive the hooks of the holder base and the mounting wings of the intermediate housing, a plurality of wire slots for the passing of the conductors of the switching component sets, and a top wall sloping downwardly outwards to the periphery of the top cover.

DETAILED DESCRIPTION OF THE PREFERRED EMBODIMENT

Referring to FIGS. 1~4, a waterproof rotary switch in accordance with a first embodiment of the present invention is shown comprised of a holder base 1, a switching component set 2, an actuator 3, and a top cover 4.

Figure 1:
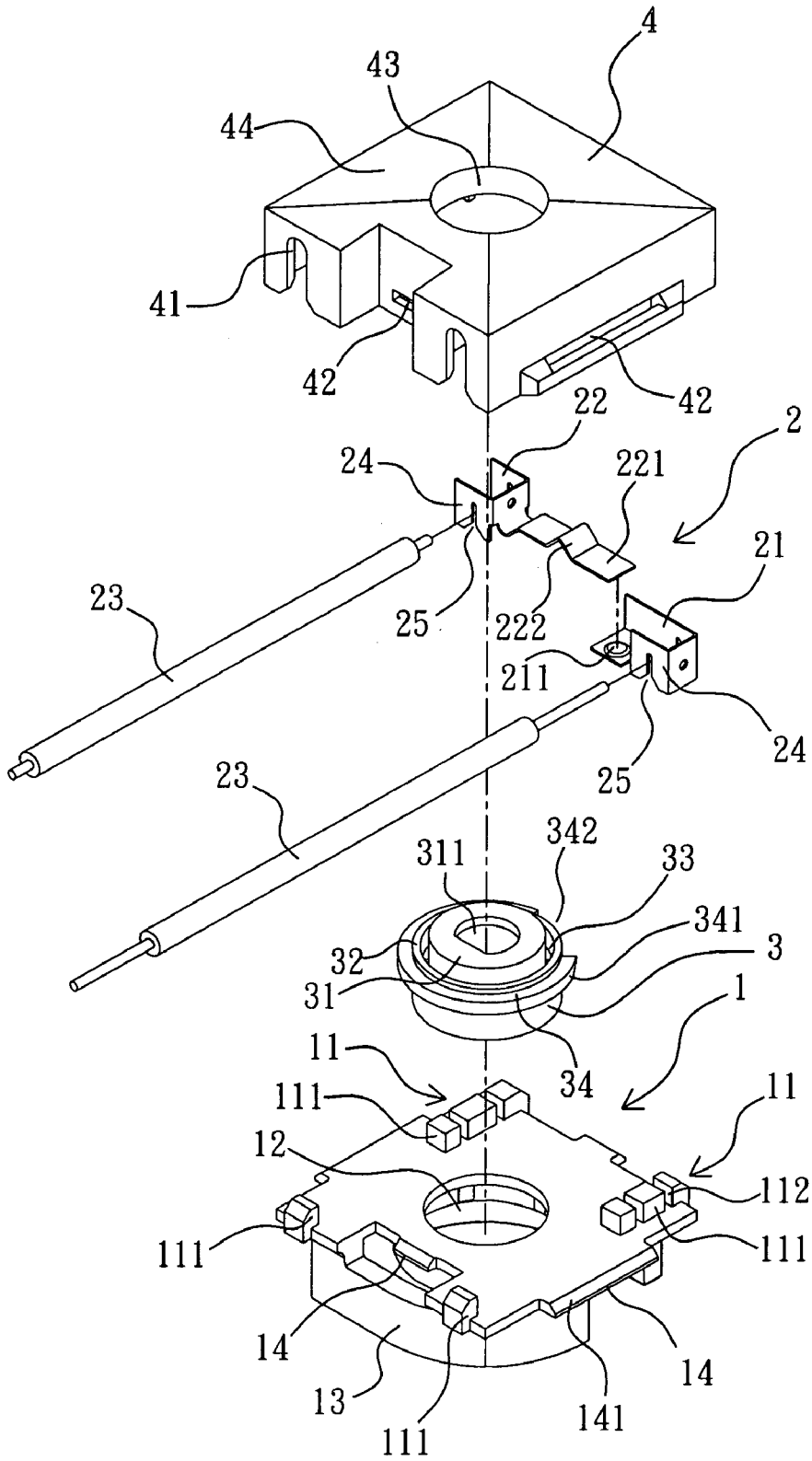
FIG. 1 is an exploded view of a waterproof rotary switch in accordance with a first embodiment of the present invention.
Figure 4:
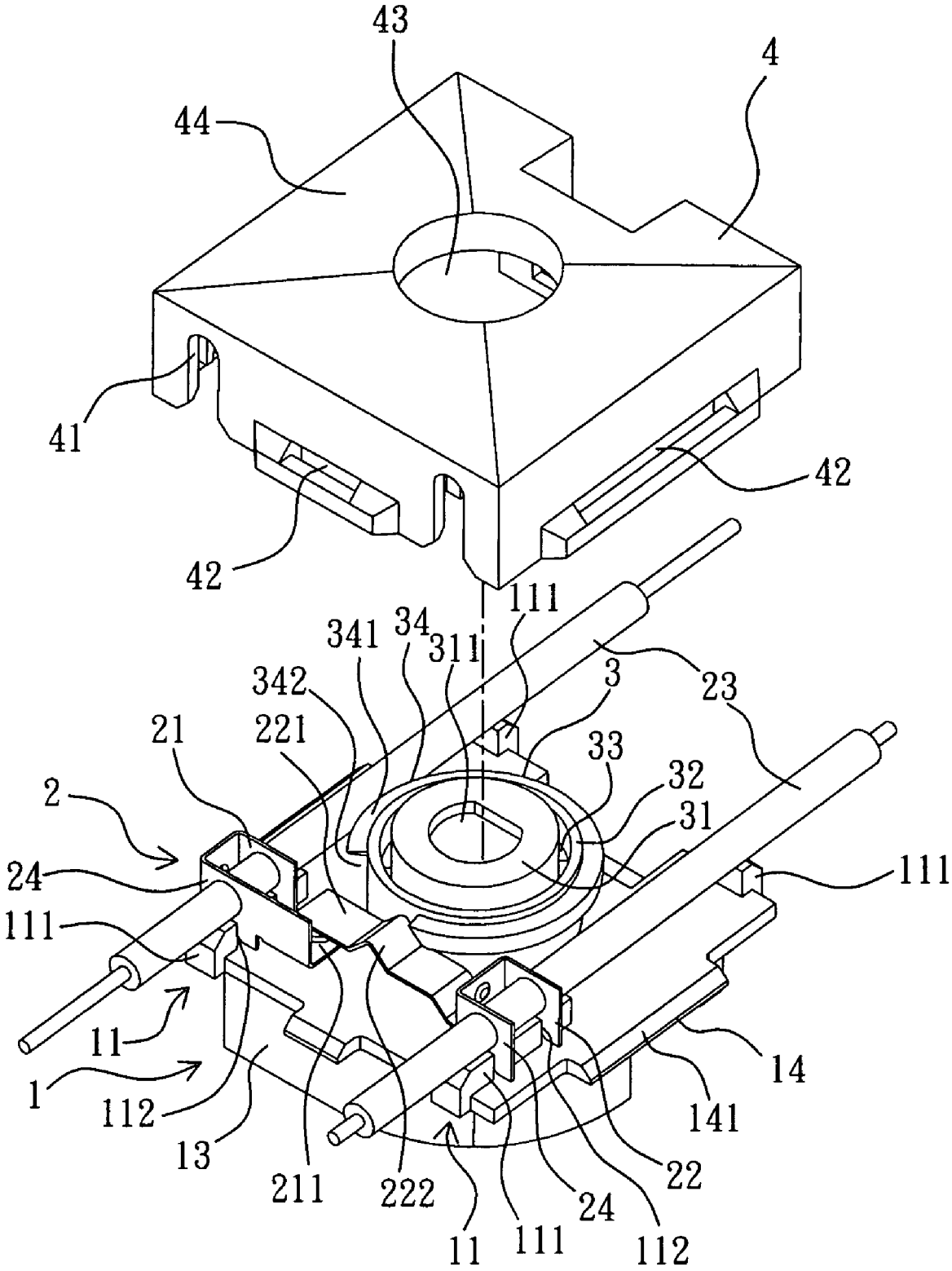
FIG. 4 is an elevational view of the waterproof rotary switch in accordance with the first embodiment of the present invention before closing of the top cover.

The holder base 1 has two support structures 11 bilaterally disposed on the top wall for supporting the switching component set 2. As shown in FIGS. 1 and 4, each support structure 11 comprises a plurality of support blocks 111. According to this embodiment, each support structure 11 comprises four support blocks 111 wherein three support blocks 111 are arranged close to one another in a line near one side with a locating groove 112 defined in between each two adjacent support blocks 111 of the three support blocks 111, and the other support block 111 is independently disposed near the opposite side and kept in line with the three support blocks 111. The holder base 1 further has a center through hole 12, a bottom mounting flange 13 downwardly extending from the bottom wall around the center through hole 12 for fastening to an external device, for example, a gas control valve (not shown), and at least one pair of hooks 14. According to this embodiment, the holder base 1 has two pairs of hooks 14 respectively protruded from the four peripheral edges for securing the top cover 4. The hooks 14 each have a beveled guide edge 141 for guiding the top cover 4 into positive engagement with the holder base 1.

The switching component set 2 is of the known device, comprising a fixed metal terminal 21, a movable metal terminal 22, and two conductors 23. The fixed metal terminal 21 and the movable metal terminal 22 each have a yoke 24 that is shaped like an open frame and has two Y-shaped notches 25 at two opposite sides for securing the conductors 23, and a contact 211 or 221 respectively extended from the yoke 24. The movable metal terminal 22 further has a protruding portion 222 connected between the yoke 24 and the contact 221. After the conductors 23 are respectively fastened to the Y-shaped notches 25 of the yokes 24 of the metal terminals 21 and 22, the yokes 24 are fastened to the locating grooves 112 in the support structures 11, keeping the conductors 23 supported on the support blocks 111. After installation, the contact 221 of the movable metal terminal 22 is spaced above the contact 211 of the fixed metal terminal 21.

Figure 2:
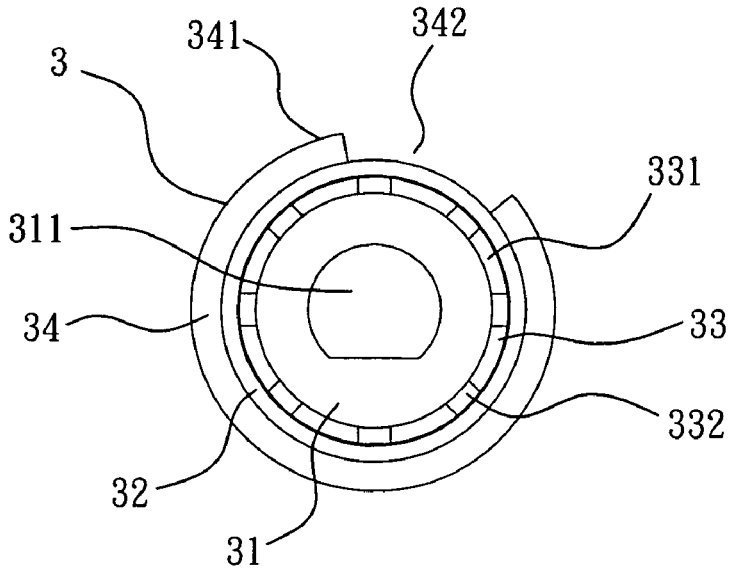
FIG. 2 is a top view of the actuator of the waterproof rotary switch shown in FIG. 1.

Referring to FIGS. 1 and 2 again, the actuator 3 is shaped like a stepped cylinder mounted in the center through hole 12 of the holder base 1. As illustrated in FIGS. 1 and 2, the actuator 3 comprises a center shaft 31 that has a non-circular coupling hole 311 for coupling to the rotary knob of the gas control valve so that the actuator 3 is rotatable with the rotary knob of the gas control valve, a flange 32 extending around the center shaft 31, an annular groove 33 defined around the center shaft 31 and surrounded by the flange 32, a connection wall 331 suspending in the annular groove 33 and connected between the center shaft 31 and the flange 32, at least one drain hole 332 in the connection wall 331 for carrying away water that leaks into the gap between the center shaft 31 and the top cover 4, and an actuating portion 34 protruding outwards from the flange 32. The actuating portion 34 has a protrusion 341 and a recess 342. When the single-loop waterproof rotary switch is not operated, the recess 342 receives the protruding portion 222 of the movable metal terminal 22. When the actuator 3 is rotated to the position where the protrusion 341 touches the protruding portion 222 of the movable metal terminal 22, the contact 221 of the movable metal terminal 22 is forced into contact with the contact 211 of the fixed metal terminal 21, thereby closing the circuit.

The top cover 4 is a bottom-open cover member fitting the top side of the holder base 1, having two pairs of U-shaped wire slots 41 symmetrically disposed at two opposite sides for the passing of the conductors 23 of the switching component set 2, a plurality of hook holes 42 on the peripheral walls for receiving the hooks 14 of the holder base 1, and a center axle hole 43 for the passing of the center shaft 31 of the actuator 3. Further, the top cover 4 has a sloping top wall 44 that slopes radially outwards in four directions from the center axle hole 43 to the four peripheral sides and is coated with a water repellent. The water repellent-coated sloping top wall 44 prevents accumulation of water on the top wall of the top cover 4, thereby reducing the change of leakage of water into the gap in between the top cover 4 and the actuator 3.

Figure 3:
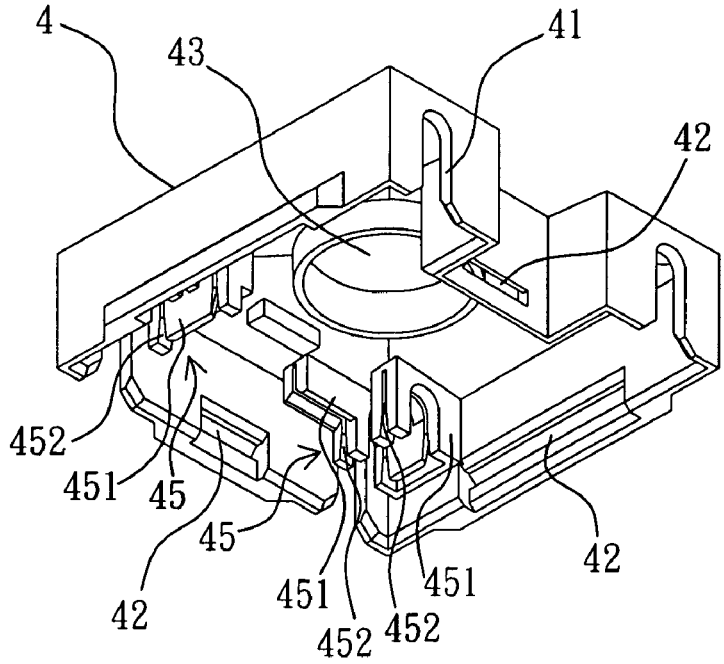
FIG. 3 is an oblique bottom elevation of the top cover of the waterproof rotary switch shown in FIG. 1.

As illustrated in FIG. 3, the top cover 4 has a locating structure 45 on the inside for securing the switching component set 2 to the support structures 11 of the holder base 1. The locating structure 45 comprises a plurality of locating ribs 451 and locating grooves 452 in the locating robs 451 corresponding to the yokes 24 of the metal terminals 21 and 22 and the conductors 23. Therefore, the locating ribs 451 and locating grooves 452 of the locating structure 45 and the support blocks 111 and locating grooves 112 of the support structures 11 hold the switching component set 2 firmly in between the holder base 1 and the top cover 4.

Figure 5:
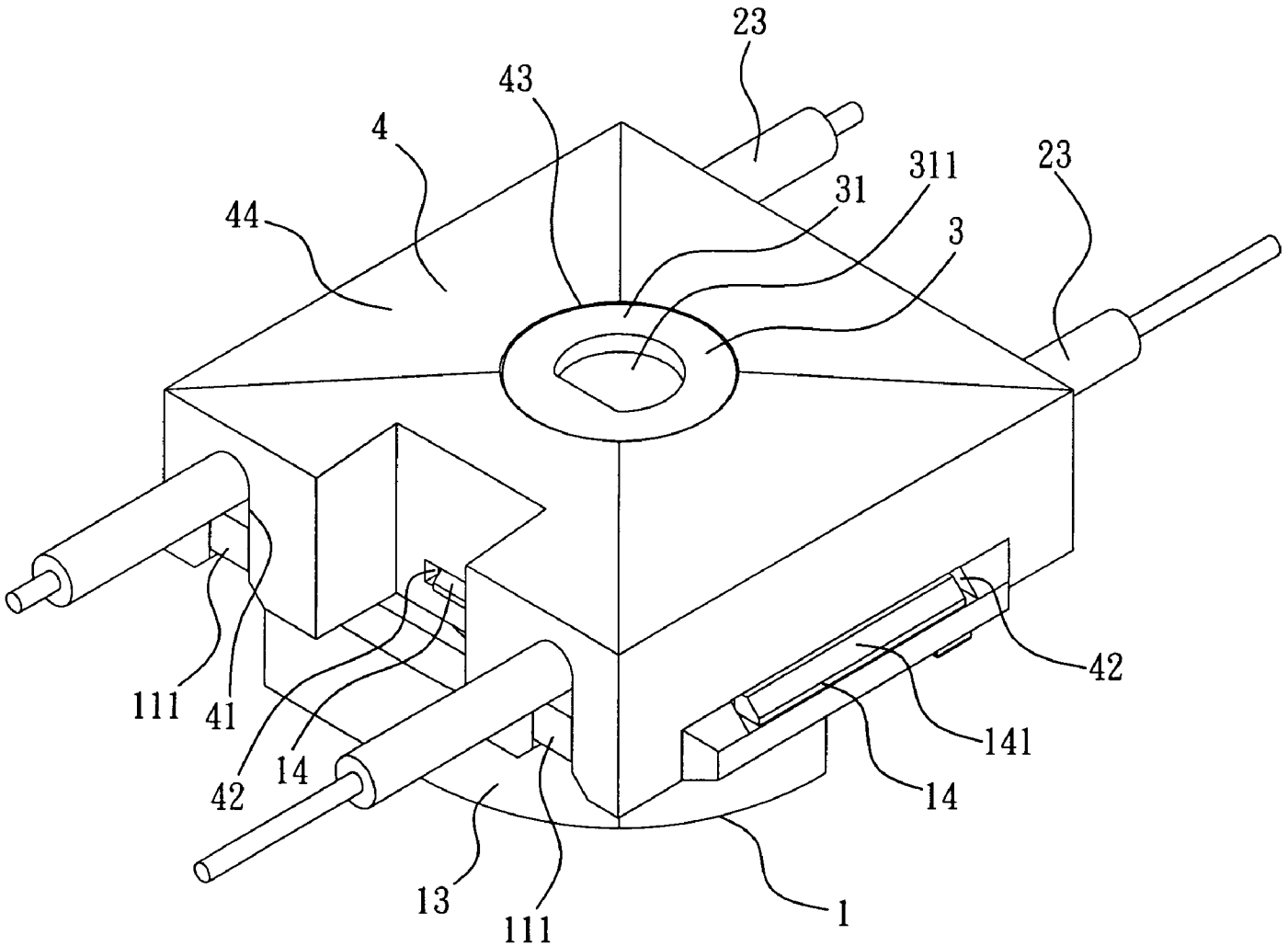
FIG. 5 is an elevational view of the waterproof rotary switch in accordance with the first embodiment of the present invention after installation of the top cover.
Figure 6:
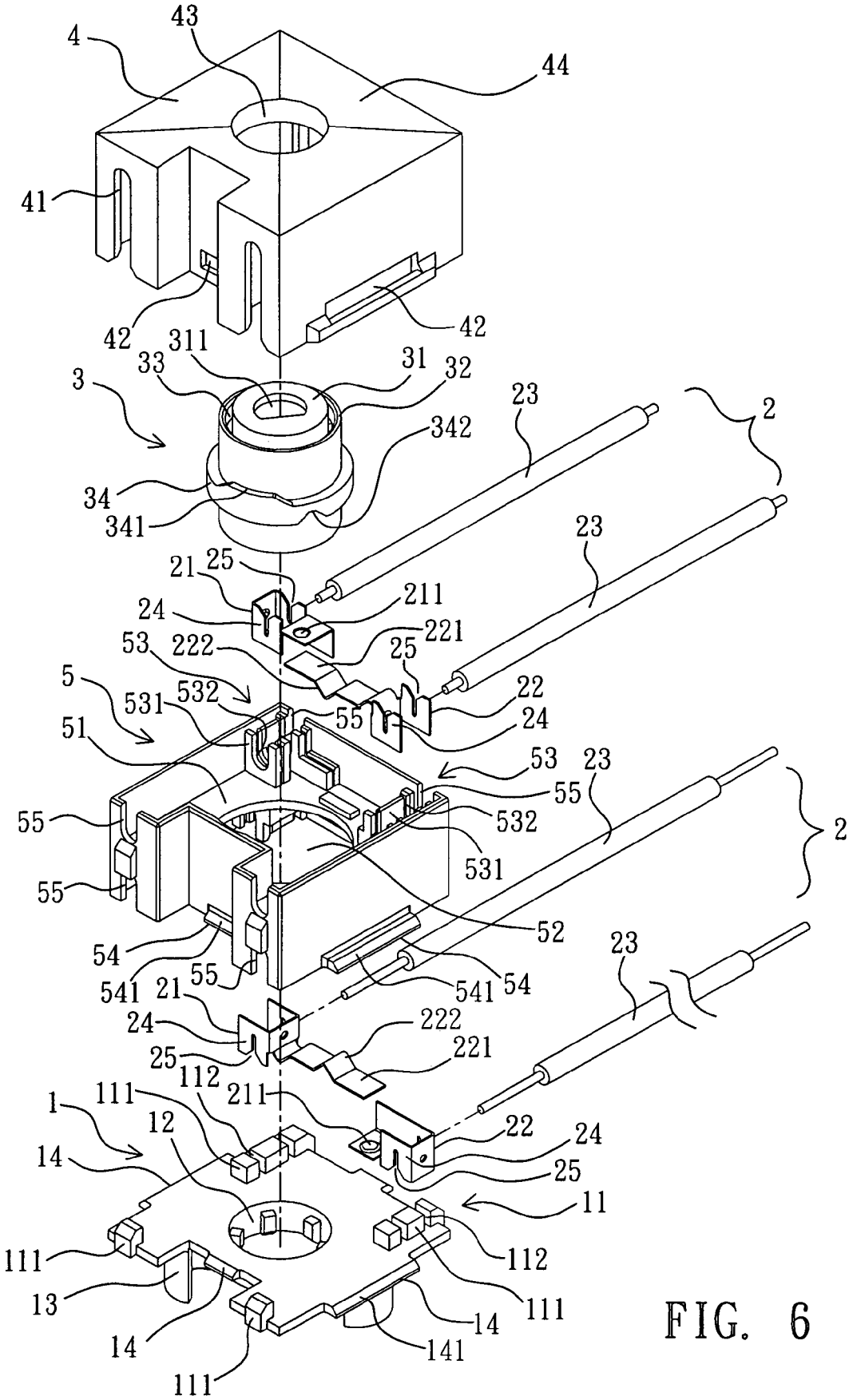
FIG. 6 is an exploded view of a waterproof rotary switch in accordance with a second embodiment of the present invention.
Figure 7A:
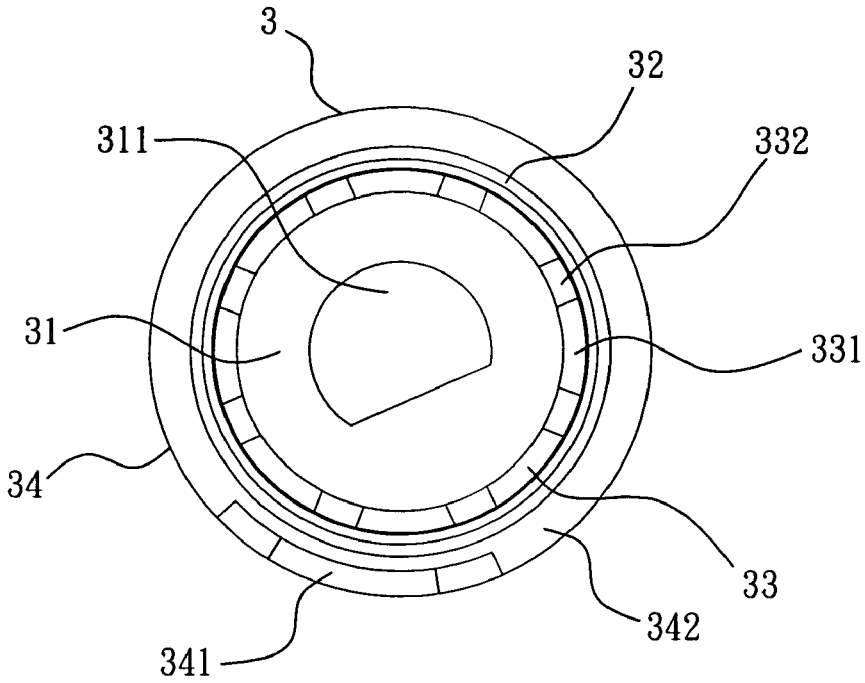
FIG. 7*a* is a front view of the actuator of the waterproof rotary switch shown in FIG. 6.
Figure 7B:
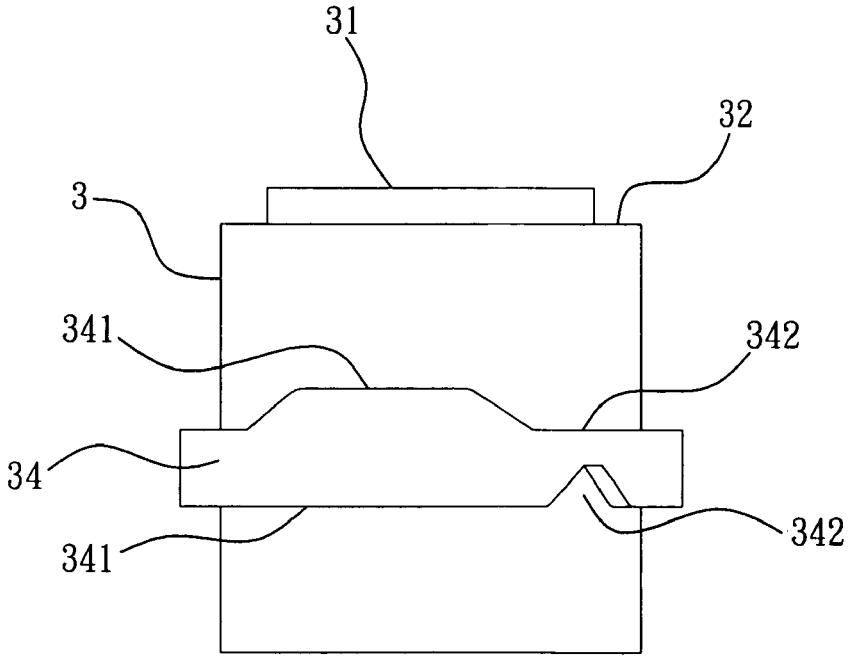
FIG. 7*b* is a top view of the actuator of the waterproof rotary switch shown in FIG. 6.
Figure 8:
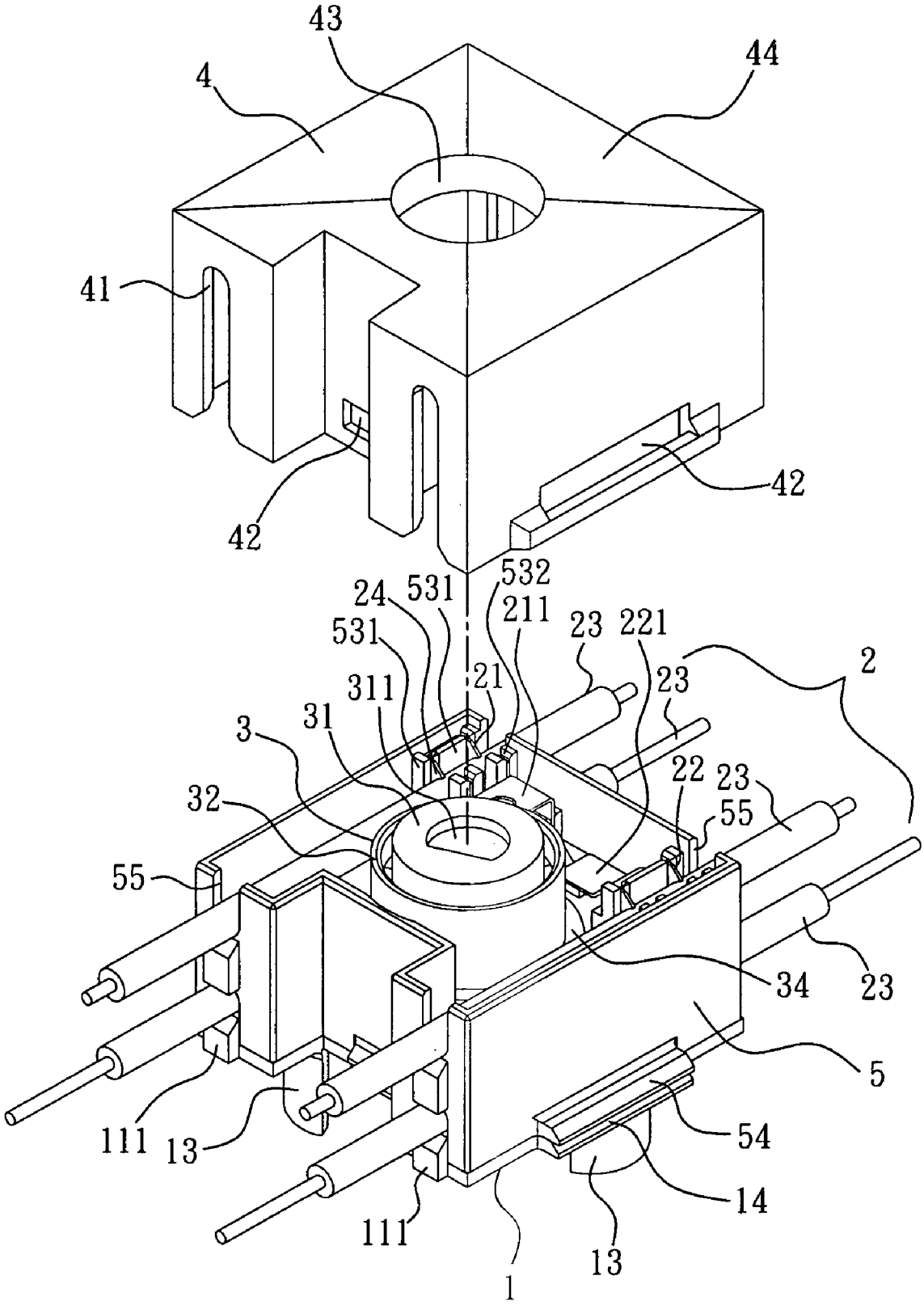
FIG. 8 is an elevational view of the waterproof rotary switch shown in FIG. 6 before closing of the top cover.

FIG. 5 illustrates the waterproof rotary switch of the first embodiment of the present invention assembled. The waterproof rotary switch of this first embodiment is a single-loop switch. By means of the design of the water repellent-coated sloping top wall 44 and the drain holes 332 of the actuator 3, the invention minimizes the possibility of leakage of water into the inside of the rotary switch, preventing a short circuit and oxidization of the internal component parts and prolonging the service life of the rotary switch.

FIGS. 6~9 show a waterproof rotary switch in accordance with the present invention. According to this second embodiment, the waterproof rotary switch is a double-loop switch comprised of a holder base 1, two switching component sets 2, an actuator 3, a top cover 4, and an intermediate switch housing 5.

The holder base 1 of this second embodiment is same as the aforesaid first embodiment. The two switching component sets 2 each are comprised of a fixed metal terminal 21, a movable metal terminal 22, and two conductors 23. The fixed metal terminal 21, the movable metal terminal 22 and the conductors 23 are identical to the like parts of the aforesaid first embodiment.

The actuator 3 of this second embodiment is substantially similar to the aforesaid first embodiment with the exception that the actuating portion 34 of the actuator of this second embodiment has two protrusions 341 and two recesses 342. When the actuator 3 is rotated to the position where one protrusion 341 is stopped against the protruding portion 222 of the movable metal terminal 22 of one switching component set 2 above the intermediate switch housing 5 to force the contact 221 of the respective movable metal terminal 22 upwards into contact with the contact 211 of the associating fixed metal terminal 21 and to close the circuit of a first loop, causing, for example, an ignition device (not shown) to ignite a gas burner (not shown), and at the same time the other protrusion 341 is stopped against the protruding portion 222 of the movable metal terminal 22 of the other switching component set 2 below the intermediate switch housing 5 to force the contact 221 of the respective movable metal terminal 22 downwards into contact with the contact 211 of the associating fixed metal terminal 21 and to close the circuit of a second loop, thereby turning on an indicator light (not shown) to indicate the burning status of the gas burner.

The top cover 4 of this second embodiment is substantially similar to the aforesaid first embodiment with exception that the height of the top cover 4 of this second embodiment is sufficient to accommodate the actuator 3 and the intermediate switch housing 5. Further, the intermediate switch housing 5 has a plurality of mounting wings 54 protruded from the periphery and respectively attached to the hooks 14 of the holder base 1 and fastened with the hooks 14 of the holder base 1 to the hook holes 42 of the top cover 4. Further, the depth of the U-shaped wire slots 41 of the top cover 4 of this second embodiment is relatively greater than the aforesaid first embodiment so that the conductors 23 of the two switching component sets 2 can be inserted through the U-shaped wire slots 41 of the top cover 4. Same as the aforesaid first embodiment, the top cover 4 of this second embodiment has a sloping top wall 44 that slopes radially outwards in four directions from the center axle hole 43 to the four peripheral sides and is coated with a water repellent.

The intermediate switch housing 5 has a height relatively smaller than the top cover 4. Further, the intermediate switch housing 5 has partition wall 51 on the middle that divides the intermediate switch housing 5 into an upper part and a lower part. The partition wall 51 has a center axle hole 52 that accommodates the actuating portion 34 of the actuator 3 for enabling the actuator 3 to switch on/off the two switching component sets 2. The intermediate switch housing 5 further comprises two locating structures 53 disposed at two opposite sides of the partition wall 51. Each locating structure 53 comprises a plurality of locating ribs 531 and a plurality of locating grooves 532 in the locating ribs 531 for securing the metal terminals 21 and 22 and conductors 23 of the switching component sets 2 in position, holding the conductors 23 of the switching component set 2 at the bottom side of the intermediate switch housing 5 on the support blocks 111 of the support structures 11 in the four corners of the holder base 1.

Figure 9:
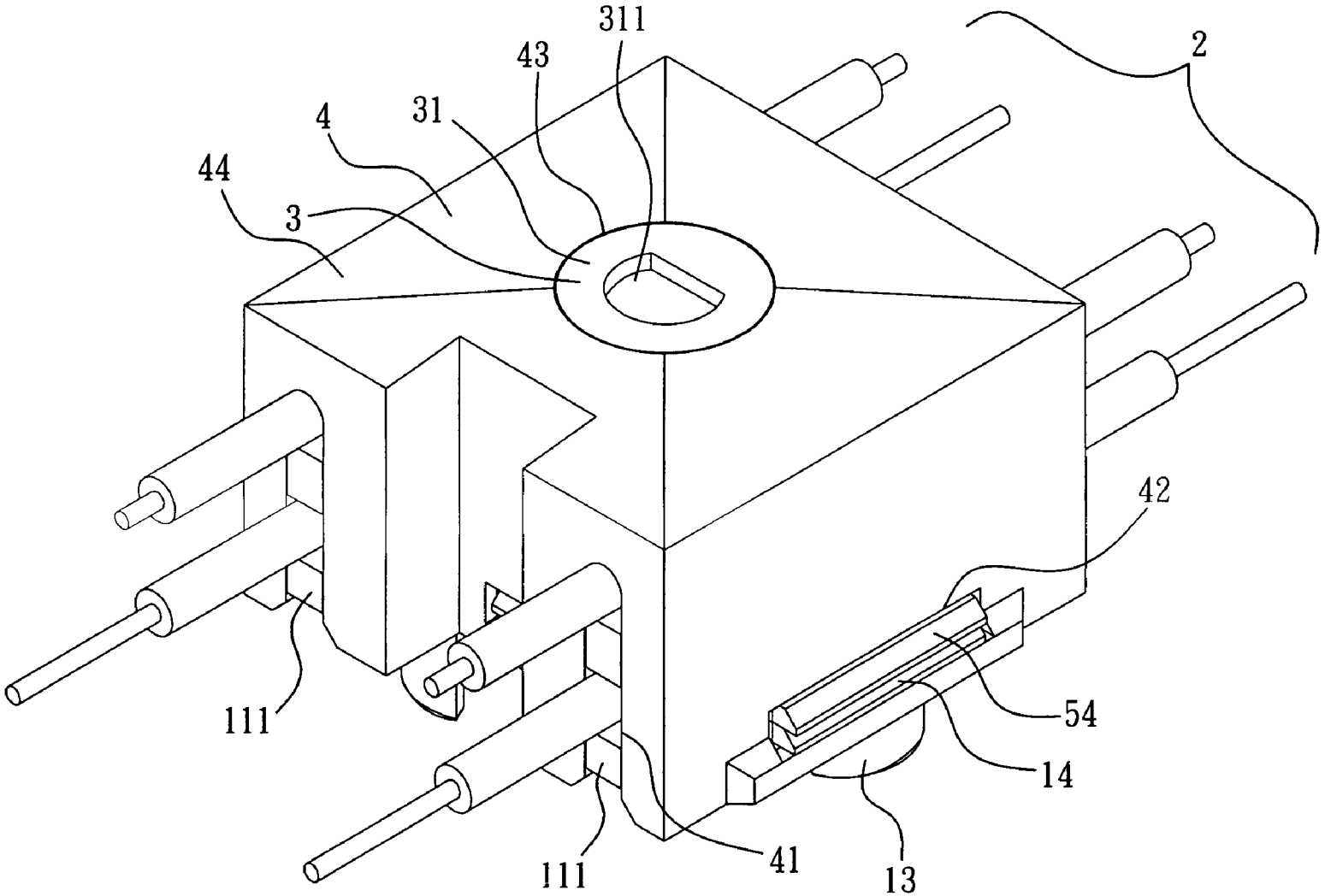
FIG. 9 is an elevational view of the waterproof rotary switch shown in FIG. 8 after installation of the top cover.

Further, the mounting wings 54 of the intermediate switch housing 5 each have a beveled guide edge 541 for guiding the respective mounting wing 54 into the corresponding hook hole 42 of the top cover 4. When the waterproof rotary switch is assembled, the intermediate housing 5 and the holder base 1 are accommodated in the top cover 4, the center shaft 31 of the actuator 3 extends out of the top cover 4 through the center axle hole 43, and the conductors 23 of the switching component sets 2 are respectively extending out of respective top and bottom wire slots 55 of the intermediate housing 5 and the U-shaped wire slot 41 of the top cover 4, as shown in FIG. 9.

By means of the design of the water repellent-coated sloping top wall 44 and the drain holes 332 of the actuator 3, the invention minimizes the possibility of leakage of water into the inside of the double-loop waterproof rotary switch, preventing a short circuit and oxidization of the internal component parts and prolonging the service life of the double-loop waterproof rotary switch.

Although particular embodiments of the invention have been described in detail for purposes of illustration, various modifications and enhancements may be made without departing from the spirit and scope of the invention.

What is claimed is:

1. A waterproof rotary switch comprising:

a holder base, said holder base comprising a plurality of hooks extending from at least two opposite peripheral sides thereof;

a switching component set mounted on said holder base, said switching component set comprising a fixed metal terminal, a movable metal terminal, and two conductors respectively connected to said fixed metal terminal and said movable metal terminal, said fixed meal terminal having a contact, said movable metal terminal having a contact movable relative to the contact of said fixed metal terminal and adapted for contacting the contact of said fixed metal terminal;

an actuator mounted in said holder base, said actuator having a center shaft, a flange extending around said center shaft, an annular groove extending around said center shaft and surrounded by said flange, a connection wall suspending in said annlar groove and connected between said center shaft and said flange, at least one drain hole cut through said connection wall, and an actuating portion rotatable with said actuator to move the contact of said movable metal terminal between a first position where the contact of said movable metal terminal contacts the contact of said fixed metal terminal and a second position where the contact of said movable metal terminal is disconnected from the contact of said fixed metal terminal; and a top cover covering said holder base to hold said switching component set and said actuator on said holder base, said top cover comprising a plurality of hook holes that receive the hooks of said holder base respectively, a plurality of wire slots for the passing of said conductors, a top wall sloping radially and downwardly outwards in four directions from the center of said top cover to four periphery sides of said top cover, and a center axle hole cut through said top wall for the passing of the center shaft of said actuator, wherein said top wall is coated with a water repellent.

2. The waterproof rotary switch as claimed in claim 1, wherein said holder base comprises two support structures arranged in parallel for supporting said conductors of said switching component set.

3. The waterproof rotary switch as claimed in claim 2, wherein said support structures each comprise a plurality of support blocks arranged in a line and adapted to support said conductors, and a plurality of locating grooves defined in between said support blocks for the positioning of said fixed metal terminal and said movable metal terminal.

4. The waterproof rotary switch as claimed in claim 1, wherein said top cover comprises a locating structure adapted to hold down said fixed metal terminal and said movable metal terminal on said holder base.

5. The waterproof rotary switch as claimed in claim 4, wherein said locating structure comprises a plurality of locating ribs, and a plurality of locating grooves formed on said locating ribs for the positioning of said fixed metal terminal and said movable metal terminal.

6. The waterproof rotary switch as claimed in claim 1, wherein said holder base has a center through hole for accommodating said actuator, and a bottom mounting flange downwardly extending from a bottom wall thereof and spaced around said center through hole.

7. The waterproof rotary switch as claimed in claim 1, wherein the hooks of said holder base each have a beveled guide edge for guiding the respective hook into the associating hook hole of said top cover.

8. The waterproof rotary switch as claimed in claim 1, wherein said fixed metal terminal and said movable metal terminal each have a yoke for fastening to the support structures of said holder base, the yokes of said fixed metal terminal and said movable metal terminal each having two wire notches at two opposite sides for securing said conductors.

9. A waterproof rotary switch comprising:

a holder base, said holder base comprising a plurality of hooks extending from at least two opposite peripheral sides thereof;

an intermediate switch housing mounted on said holder base, said intermediate switch housing comprising a partition wall disposed on a middle part thereof and dividing said intermediate switch housing into an upper part and a lower part, a center axle hole cut through the center of said intermediate partition wall, two locating structures respectively disposed at top and bottom sides of said partition wall, and a plurality of mounting wings respectively attached to the hooks of said holder base;

two switching component sets respectively mounted in the locating structures of said intermediate housing at two opposite sides of said partition wall, said switching component sets each comprising a fixed metal terminal, a movable metal terminal, and two conductors respectively connected to said fixed metal terminal and said movable metal terminal, said fixed metal terminal having a contact, said movable metal terminal having a contact movable relative to the contact of said fixed metal terminal and adapted for contacting the contact of said fixed metal terminal;

an actuator mounted in said holder base and inserted through the center axle hole of said partition wall, said actuator having a center shaft, a flange extending around said center shaft, an annular groove extending around said center shaft and surrounded by said flange, a connection wall suspending in said annular groove and connected between said center shaft and said flange, at least one drain hole cut through said connection wall, and an actuating portion rotatable with said actuator to move the contacts of the movable metal terminals of said two switching component sets between a first position where the contacts of the movable metal terminals of said two switching component sets respectively contact the contacts of the fixed metal terminals of said two switching component sets and a second position where the contacts of the movable metal terminals of said switching component sets are respectively disconnected from the contacts of the fixed metal terminals of said switching component sets; and a top cover covering said intermediate housing and said holder base to hold said intermediate housing and said switching component sets and said actuator on said holder base, said top cover comprising a plurality of hook holes that receive the hooks of said holder base and the mounting wings of said intermediate housing, a plurality of wire slots for the passing of the conductors of said switching component sets, and a top wall sloping radially and downwardly outwards in four directions from the center of said top cover to four periphery sides of said top cover, and a center axle hole cut through said top wall for the passing of the center shaft of said actuator, wherein said top cover is coated with a water repellent.

10. The waterproof rotary switch as claimed in claim 9, wherein the actuating portion of said actuator comprises a protrusion and a recess at a top side thereof adapted and a protrusion and a recess at a bottom side thereof and adapted for moving the contacts of the movable metal terminals of said two switching component sets respectively.

11. The waterproof rotary switch as claimed in claim 9, wherein said holder base comprises two support structures arranged in parallel for supporting the conductors of one of said switching component set in between said holder base and said intermediate switch housing.

12. The waterproof rotary switch as claimed in claim 11, wherein said support structures each comprise a plurality of support blocks arranged in a line and adapted to support the conductors of the associating switching component set, and a plurality of locating grooves defined in between said support blocks for the positioning of the fixed metal terminal and movable metal terminal of the associating switching component set.

13. The waterproof rotary switch as claimed in claim 9, wherein said top cover comprises a locating structure adapted to hold down the fixed metal terminal and movable metal terminal of one of said two switching component sets in between said intermediate switch housing and said top cover, said locating structure comprising a plurality of locating ribs and a plurality of locating grooves formed on said locating ribs for the positioning of the fixed metal terminal and movable metal terminal of the associating switching component set.

14. The waterproof rotary switch as claimed in claim 9, wherein said holder base has a center through hole for accommodating said actuator, and a bottom mounting flange downwardly extending from a bottom wall thereof and spaced around said center through hole.

15. The waterproof rotary switch as claimed in claim 9, wherein the hooks of said holder base each have a beveled guide edge for guiding the respective hook into the associating hook hole of said top cover.

16. The waterproof rotary switch as claimed in claim 9, wherein the fixed metal terminals and movable metal terminals of said switching component sets each have a yoke for fastening, the yokes of the fixed metal terminal and movable metal terminal of said switching component sets each having two wire notches at two opposite sides for securing the conductors of the respective switching component set.

* * * * *